United States Patent [19]

Schmidt

[11] 4,018,290

[45] Apr. 19, 1977

[54] HYDRAULICALLY DRIVEN VIBRATOR

[75] Inventor: Paul Schmidt, Lennstadt, Saalhausen, Germany

[73] Assignee: Tracto-Technik Paul Schmidt, Lennstadt, Saalhausen, Germany

[22] Filed: Aug. 4, 1975

[21] Appl. No.: 601,637

[30] Foreign Application Priority Data

Sept. 4, 1974 Germany ..... 2442367

[52] U.S. Cl. ..... 173/49; 175/55; 175/19; 74/61

[51] Int. Cl.[2] ..... E02D 7/18; E21C 3/02

[58] Field of Search ..... 173/49; 74/61, 87; 175/19, 55; 61/53.5; 294/652, 128

[56] References Cited

UNITED STATES PATENTS

| | | | |
|---|---|---|---|
| 3,291,224 | 12/1966 | Stutz | 173/49 |
| 3,368,632 | 2/1968 | Lebelle | 175/55 X |
| 3,583,497 | 6/1971 | Sopot et al. | 173/49 |
| 3,828,864 | 8/1974 | Haverkamp et al. | 61/53.5 |
| 3,865,501 | 2/1975 | Kniep | 173/49 |

*Primary Examiner*—Ernest R. Purser
*Assistant Examiner*—Richard E. Favreau
*Attorney, Agent, or Firm*—Toren, McGeady and Stanger

[57] ABSTRACT

A hydraulically driven vibrator, for example, of the kind used for driving or extracting sheet piles comprises a number of out-of-balance masses which are all rotatably mounted side by side for rotation about a common axis. The masses are arranged in at least two pairs, one pair being rotated synchronously with the other pair, but in an opposite direction in such a way that on rotation the masses produce vibratory forces which are additive in a direction longitudinally of the vibrator, but mutually cancel each other out in a direction transversely of the vibrator. The pairs of masses are coupled by driving chains or toothed driving belts to oppositely rotatable drive outputs of a hydraulic motor which is offset longitudinally of the vibrator from the common rotational axis of the pairs of masses. Preferably one pair of masses is keyed on a drive shaft and another pair of masses are rotatable around the drive shaft and are mounted between the two masses forming the first pair. The other pair of masses are preferably mounted on a fixed hollow shaft which surrounds the drive shaft coaxially.

8 Claims, 2 Drawing Figures

HYDRAULICALLY DRIVEN VIBRATOR

This invention relates to hydraulically driven vibrators which are intended, for example, for extracting sheet piles.

Numerous vibrators are known, which are used as vibration-exciters for example in driving or pulling devices, vibrating rollers, vibrating machines and tampers. Some of these vibrators have electrical drives and others hydraulic drives. Whereas, with electrical drives, double or quadruple out-of-balance masses are frequently set in counter rotation, hydraulic drives are only known in association with a single out-of-balance mass. In each case, excitation forces acting in at least one direction of the vibrator are produced and these are utilised for driving, extracting, vibrating and compacting.

In one form of electrically driven vibrator disclosed in German Specification No. 2,135,393, which serves as a vibrating device for driving or extending a driven object, oppositely rotating out-of-balance masses, the excitation forces from which are mutually additive longitudinally of the vibrator and mutually cancelling transversely thereto, are mounted on different shafts and are driven by one or more electric motors. Apart from the fact that electric driving motors have a relatively high weight-power ratio and require high start up currents for a rapid start, often necessitating special electrical circuits, these known vibrators suffer from the substantial disadvantage that they are relatively large, and therefore often unsuitable for working in narrow or confined working spaces. When driving and extracting sheet piling, this has the effect that, with existing driving and extracting devices which are frequently wider than a single pile, it is always only possible for each alternate pile to be extracted or driven.

In contrast, existing hydraulically driven vibrators possess the advantage that they can be simply attached to hydraulic power outputs of hydraulic appliances, such as hydraulic excavators, and therefore no electrical energy source is necessary. Vibrators of this type are, on account of their substantially smaller weight-power ratio compared with electrical drives, lighter and also cheaper. On the other hand, in existing vibrators of this type, the hydraulic drive acts only upon a single out-of-balance weight supported on both sides by compression springs, and low vibrational efficiency and an unfavourable vibrational behaviour, due to lack of vibration compensation in undesired directions, result.

The object of this invention therefore consists in the provision of a hydraulically driven vibrator which, while avoiding the disadvantages, possesses the advantages of electrically driven vibrators, whih is very compact and easy to handle and can be used to act on relatively small components or to operate in confined areas.

To this end, according to this invention, a hydraulically driven vibrator, for use, for example for driving and extracting sheet piles, comprises at least two oppositely and sychronously rotatably driven out-of-balance pairs of masses arranged alongside one another, the excitation forces produced by rotation of the masses being additive in a direction longitudinally of the vibrator and mutually cancelling in a direction transversely thereof, the masses being rotatable about a common axis, and being coupled by driving chains or belts to oppositely rotatable drive outputs of a hydraulic motor which is offset longitudinally of the vibrator from the common axis.

The relatively light and small hydraulic motor is coupled to the uniaxial out-of-balance pairs of masses and this permits the masses to be brought very close together and therefore makes possible a slender construction of the vibrator. This is especially so because the hydraulic motor drives the separate out-of-balance masses from a longitudinally offset position, so that the width of the vibrator only needs to accommodate the width of the different out-of-balance masses. Since no longitudinally offset multiple driving shafts are used, this results in very easy handling and simplified maintenance. In addition, an oppositely rotating drive, which can be sychronized very simply and exactly, is obtainable by means of a single hydraulic motor, and excitation forces in undesired directions are almost completely eliminated.

In order to compensate for tilting moments of the vibrator and for constructional reasons, in a preferred construction, one pair of the out-of-balance masses is keyed on a drive shaft and the other pair of out-of-balance masses are rotatable around the drive shaft and are mounted between the two masses forming the first pair. Preferably, the other pair of out-of-balance masses are rotatably mounted on a fixed hollow shaft which surrounds the drive shaft co-axially.

The oppositely rotating out-of-balance masses result in a comparatively uniform loading of the drive shaft and in a reduction of undesired vibrating phenomena or oscillation forces transversely or obliquely to the longitudinal direction of the vibrator. Also, the hollow shaft mounting for the other pair of masses makes possible, in comparison with a mounting directly upon the drive shaft, an increase in the load bearing capacity and life of corresponding bearing components.

In one advantageous embodiment, the drive shaft and the other pair of out-of-balance weights are coupled respectively at one end and centrally each to one of two toothed drive wheels of equal sizes the two toothed drive wheels being driven each by one of two further toothed drive wheels of equal sizes forming the outputs of the hydraulic motor. In this arrangement, the drive wheel of the drive shaft is preferably outside the frame. The arrangement of the drive wheels and especially the drive wheel at one end of the shaft outside the frame has the result that the vibrator is very slender, possessing a narrow frame or box construction without substantial projecting parts. The equal sized drive wheels lead, in conjunction with the single hydraulic motor, in a simple manner and without additional measures to the required synchronisation of the unbalanced movements.

A very favourable embodiment for use as a pile driving or extracting device for attachment to hydraulically operated plant, especially a hydraulic excavator has a suspension at its top, and at its bottom a hydraulically actuated clamping device and the frame can be rotated about its longitudinal axis relative to the suspension by means of a hydraulic twisting motor. This enables the driving or extracting device, which is frequently suspended from a rope by a sheave at its top end or in some other manner, to be reliably and accurately aligned on a pile or other object to be driven or extracted. Since the alignment is also carried out hydraulically, oil pumps which are in any case provided can be utilised for the drive, aligning and clamping operations.

In one embodiment, the suspension includes a spindle which extends through and is rotatable relative to a part of the frame and the damping spring, and the spindle is connected to the hydraulic twisting motor through a chain or belt which passes around a wheel on the end of the spindle. With this arrangement, the twisting motor is itself rotated together with the vibrator frame relative to the suspension. This enables the whole drive to be concentrated on the vibrator, so that the suspension as such can be very simple.

An example of a vibrator constructed in accordance with the invention is illustrated in the accompanying drawings, in which.

Figure 1:
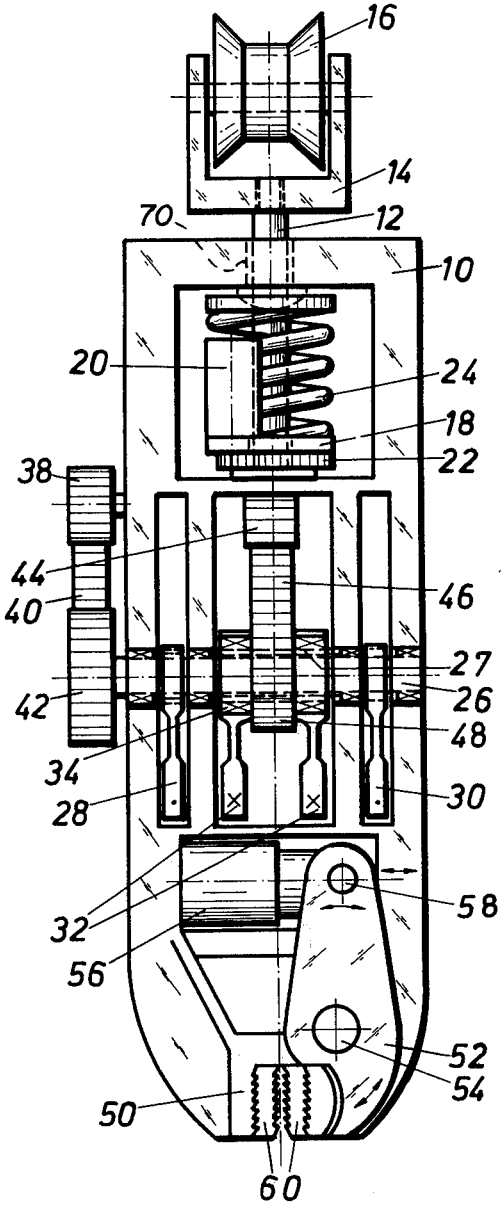
FIG. 1 is a somewhat diagrammatic front view.

The vibrator shown in the drawings is in the form of a sheet pile extractor and it has a spindle 12 of an upper suspension passing with a suitable rotational clearance through a bearing opening in a frame 10 of the vibrator. The suspension comprises a sheave 16 journalled at both ends in a yoke 14. The spindle 12 also passes through a steel plate 18, to which is connected a damping member in the form of a buffer spring 24, and a sprocket wheel F1 is fixed on the end of the spindle 12 and is engaged by a chain or belt drive 22. The drive 22 is driven by a hydraulic twisting motor 20 which is mounted on the steel plate 18 and serves for twisting or aligning the frame 10 relative to the suspension 12, 14, 16. In addition, the damping spring 24 is situated between the steel plate 18 and the frame 10, which bears against the damping spring, thus preventing vibrational forces from being transmitted to the suspension or allowing them to be transmitted only in a very damped state.

Figure 2:
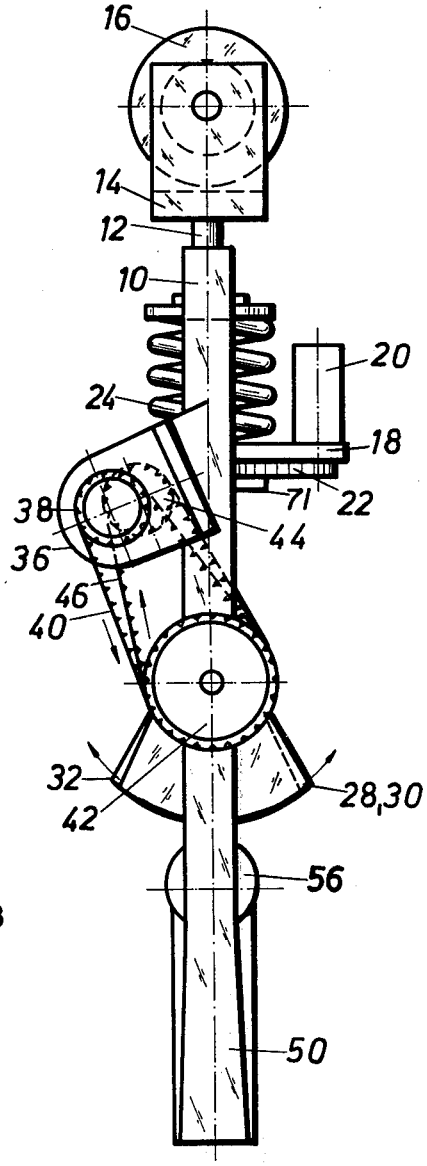
FIG. 2 is a side view.

In its middle portion the frame 10 is traversed by a drive shaft 26, to which are keyed two outer out-of-balance masses 28, 30. Between the outer masses 28, two middle out-of-balance masses 32, which are arranged to produce the same total excitation force as the masses 28, 30, are rotatably mounted by means of bearings 34 on a hollow shaft 27 which is mounted coaxially with the drive shaft 26. Two toothed driving sprocket wheels 42, 48, preferably of the same diameter as each other, are situated outside the frame 10 on one end of the drive shaft 26 and centrally between the middle out-of-balance masses 32, respectively. The wheel 48 is rotatable on the shaft 27 and fixed to the masses 32. The drive wheels 42, 48 and thus also the out-of-balance masses 28, 30 on the one hand and 32 on the other hand are synchronously rotated in opposite directions as indicated by arrows in FIG. 2. As shown in FIG. 2, a hydraulic driving motor 36 is mounted laterally on the frame 10 between the suspension spindle 12 and the shaft 26 and acting through toothed sprocket wheels 38, 44 also equal in size, and driving chains or toothed belts 40, 46 rotates the masses 28, 30 and 32. To produce the opposite rotational movements of the masses, the hydraulic motor is coupled to a reversing gear box, which is not shown in detail but which as shown in FIG. 2 comprises axially offset and oppositely rotating outputs having the same rotational speed. From FIG. 2 it can also be seen that the out-of-balance masses 28, 30 on the one hand and 32 on the other hand overlap in the top and bottom dead-centre positions, whereas in intermediate positions they are situated at opposite sides of the vibrator, thus causing the transverse forces to cancel out. Since all the out-of-balance masses rotate and are symmetrically disposed around a single axis, practically all the vibrational disturbances and tilting oscillations occuring in known multi-shaft arrangements are eliminated.

The lower part of the frame 10 is equipped firstly with a fixed clamping arm 50 and secondly with a pivotally movable clamping arm 52, in the form of a two-armed lever journalled at a pivoting axis 54. The longer lever arm of the pivoting arm 52 is pivotally connected via a pivot pin 58 to a piston rod, not referenced, of a hydraulic cylinder 56, so that a linear movement of the piston rod, moves the short arm of the pivoting arm 52 towards or away from the clamping arm 50. Between the facing portions of the clamping arms 50, 52, there are clamping jaws 60, for gripping an object to be driven or extracted, for example a sheet pile. The clamping jaws 60 are provided at opposite faces with toothed profiles extending perpendicularly to the plane of driving, so that when wear has occurred one or both clamping jaws 60 can be turned round.

All the drives of the very compact and easily handled vibrator which are constructed correctly from vibrational aspects, for the mutually opposed movements of the out-of-balance masses and for the aligning and clamping operations, are hydraulic, so that they can be driven from a single pump of a hydraulic apparatus which carries the vibrator.

I claim:

1. A hydraulically driven vibrator comprising a frame, at least two pairs of out-of-balance masses arranged alongside one another, means rotatably mounting the masses in the frame for rotation about a common axis, means for rotating one pair of masses in one direction, means for rotating the other pair of masses synchronously with said first pair of masses, but in an opposite direction thereto, whereby rotation of said masses produces vibratory forces which are additive in a direction longitudinally of said frame, but are mutually cancelling in a direction transversely of said frame, driving means including a hydraulic motor, means mounting said motor to said frame in a position offset longitudinally of said frame from said common rotational axis, two oppositely rotatable drive outputs of said motor and flexible driving means coupling one of said outputs to one of said pairs of masses and coupling the other of said outputs to the other of said pairs of masses.

2. A vibrator as claimed in claim 1, further comprising suspension means and supporting means supporting said frame from said suspension means, said supporting means including at least one damping spring.

3. A vibrator as claimed in claim 2, further comprising means for rotating said frame about a longitudinal axis thereof relative to said suspension, said means for rotating said frame including a hydraulic twisting motor.

4. A vibrator as claimed in claim 3, wherein said suspension includes a spindle, means defining a bearing opening in said frame, said spindle extending rotatably through said opening, a sprocket wheel fixed on said spindle, means fixedly mounting said hydraulic twisting motor to said frame and flexible driving means operatively connecting said hydraulic twisting motor to said sprocket wheel.

5. A vibrator as claimed in claim 3, further comprising a clamping device and means mounting said clamping device on said frame, a hydraulic cylinder mounted on said frame and means operatively connecting said hydraulic cylinder to said clamping device.

6. A vibrator as claimed in claim 5, wherein said clamping device includes a fixed clamping arm, a pivotally movable clamping arm, reversible clamping jaws mounted on said fixed and said pivotally movable clamping arms, and toothed profiles on each of two opposite faces of each of said reversible clamping jaws.

7. A vibrator according to claim 1 wherein said means rotatably mounting the masses in the frame for rotation about a common axis comprise a drive shaft having said one pair of masses secured thereon and a hollow shaft coaxial with said drive shaft having said other pair of masses rotatably mounted thereon, said vibrator further including a pair of toothed driving wheels of equivalent size each drivingly connected with said hydraulic motor and having, respectively, said drive shaft and said other pair of masses coupled thereto.

8. A vibrator as claimed in claim 7, wherein said driving wheel which is fixed to said drive shaft, is situated outside said frame.

* * * * *